United States Patent [19]

Ida

[11] Patent Number: 4,977,650

[45] Date of Patent: Dec. 18, 1990

[54] BUCKLE ASSEMBLY

[75] Inventor: Kazuo Ida, Toyama, Japan

[73] Assignee: Yoshida Kogyo K. K., Tokyo, Japan

[21] Appl. No.: 489,041

[22] Filed: Mar. 5, 1990

[30] Foreign Application Priority Data

Mar. 10, 1989 [JP] Japan ..... 1-27950[U]

[51] Int. Cl.[5] ..... A44B 11/25

[52] U.S. Cl. ..... 24/614; 24/615; 24/633

[58] Field of Search ..... 24/614, 615, 633, 662, 24/625, 324

[56] References Cited

U.S. PATENT DOCUMENTS

| | | | |
|---|---|---|---|
| 4,679,282 | 7/1987 | Feng | 24/614 |
| 4,802,262 | 2/1989 | Kasai | 24/615 |
| 4,864,700 | 9/1989 | Kasai | 24/614 |
| 4,866,819 | 9/1989 | Kasai | 24/614 |

*Primary Examiner*—Victor N. Sakran

*Attorney, Agent, or Firm*—Hill, Van Santen, Steadman & Simpson

[57] ABSTRACT

A buckle comprises a plug including a protuberant arm having first engaging means; and a socket adapted to be releasably coupled with the plug. The lower wall of the socket has a cantilevered engaging flap provided on its inner surface thereof and having second engaging means for snapping engagement with the first engaging means for coupling of the plug and the socket. The upper wall of the socket has a cantilevered resilient presser flap overhanding the cantilevered engaging flap and being yieldable downwardly to thus depress the resilient engaging flap, thereby bringing the second locking means out of engagement with the first engaging means of the protuberant arm for uncoupling the plug from the socket. The buckle further includes a locking plate slidably mounted on the presser flap for reciprocation between its locking position and its unlocking position.

11 Claims, 5 Drawing Sheets

BUCKLE ASSEMBLY

BACKGROUND OF THE INVENTION

1. Field of the Invention

The present invention relates generally to a buckle made of synthetic resin and used for joining a belt incorporated in clothes, baggages, canteens and so forth and particularly to such a buckle equipped with a locking mechanism for locking the buckle in coupled disposition.

2. Description of the Prior Art

A typical buckle with a locking mechanism of the type described is disclosed in Japanese Utility Model Publication No. 57-13305. The disclosed buckle generally comprises a plug having a pair of parallel resilient arms, a socket in the form of a rectangular casing for receiving the arms and a locking mechanism provided on the socket and being movable between unoperative position and operative position in which to lock the plug and socket in coupled disposition. The resilient arms have their respective outer edges tapered towards their distal ends. As being inserted into the socket, the resilient arms of the plug are gradually compressed toward each other against their resiliency and are finally, under their resiliency, spread into snapping engagement with shoulders proposed on the opposed sides of the socket, so that the plug and socket are coupled together. In this instance, the locking mechanism moves to interfere between the thus spread arms to thus prevent the spread arms from getting compressed toward each other so that the plug and the socket can be locked in coupled disposition.

However, the conventional buckle of the type described has several drawbacks. In this buckle, the plug and the socket cannot be uncoupled without compressing the resilient arms while or after removing the locking mechanism out of between the resilient arms. Either two actions by one hand or one action by two hands are, thus, required to uncouple the buckle, resulting in tedious manipulation.

Furthermore, in this conventional buckle, there is no means to retain the locking mechanism in locking disposition, so that the locking mechanism would be liable to get accidentally released from locking disposition under severe stresses exerted thereon.

Still furthermore, the socket of this buckle is constructed to house the locking mechanism therein, necessarily becoming the larger in size.

SUMMARY OF THE INVENTION

With the foregoing drawbacks in view, it is therefore an object of the present invention to provide a buckle which is less expensive and wherein it is easy to couple a plug and a socket of the buckle and lock them in coupled disposition as well as to unlock and uncouple the plug and the socket, and wherein the plug and socket are assuredly prevented from getting unlocked and hence uncoupled accidentally.

According to the present invention, there is provided a buckle comprising a plug including a protuberant arm having first engaging means; and a socket adapted to be releasably coupled with the plug; the socket including a socket body including a pair of spaced upper and lower walls, a pair of side walls joining the upper and lower walls on their respective sides and a rear wall provided on the rear end of the lower wall to thus define therebetween a guide chamber open forwardly, the lower wall having a cantilevered resilient engaging flap projecting from its inner surface toward the rear wall and having second engaging means for snapping engagement with the first engaging means of the plug, the upper wall having a cantilevered resilient presser flap overhanging the cantilevered resilient engaging flap and being yieldable downwardly to thus depress the resilient engaging flap; and a locking plate having an abutting means and slidably mounted on the presser flap for causing the abutting means to come into abutting engagement with the rear wall, to thus lock the plug and the socket in coupled disposition.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
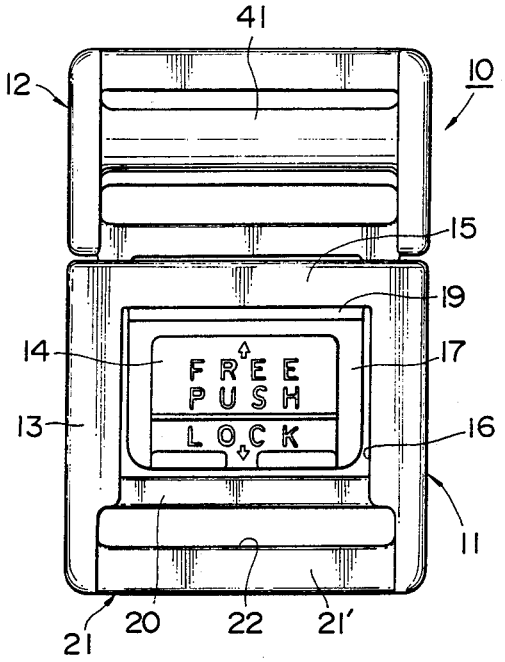
FIG. 1 is a front elevational view of a buckle according to the present invention, showing a locking plate to assume unlocking position.
Figure 2:
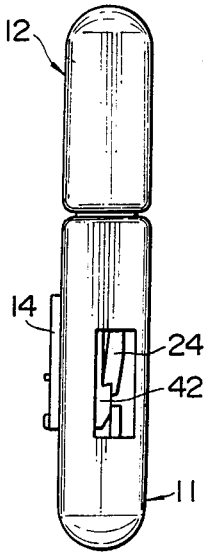
FIG. 2 is a side elevational view of the buckle of FIG. 1.

FIGS. 1 and 2 show a buckle 10 embodying the present invention in coupled disposition. The buckle 10 is made of synthetic resin and broadly comprises a socket 11 and a plug 12 for coupling engagement with the socket 11.

Figure 3:
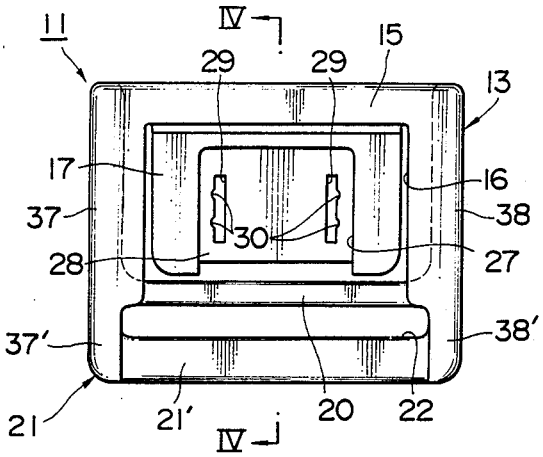
FIG. 3 is a front elevational view of a socket of the buckle with the locking plate detached therefrom.
Figure 4:
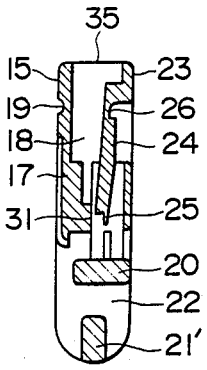
FIG. 4 is a cross-sectional view taken on line IV—IV of FIG. 3.
Figure 5:
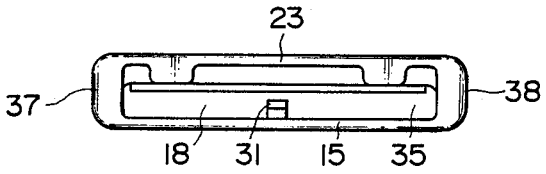
FIG. 5 is a plan view of the socket of FIG. 3.

The socket 11 generally comprises a socket body 13 and a belt attaching portion 21 shown in FIGS. 3 through 5 and a locking plate 14 shown in FIGS. 6 through 9. The socket body 13 is in the form of a rectangular hollow case and comprises a pair of upper and lower walls 15, 23, a pair of side walls 37, 38 joining the upper and lower walls 15, 23 on and along their respective lateral edges and a rear wall 20 connecting the side walls 37, 38 at their respective rear ends to thus define therebetween a guide chamber 18 made open forwardly for receiving therein protuberant arms 42 of the plug 12 as closely described hereinafter. The front wall 15 has a U-shaped cut-away slit 16 formed therein to thus define therebetween a tongue-like cantilevered resilient presser flap 17. The presser flap 17 has a groove 19 formed in its upper surface at its proximal end to thus yieldingly flex downwardly or toward the lower wall 23. As shown in FIG. 4, the rear wall 20 has a thickness such that its upper surface is slightly lower than that of the front wall 15. The lower wall 23 has a cantilevered resilient engaging flap 24 provided on the inner surface thereof so as to project slantly upwards toward the rear wall 20. The engaging flap 24 has an engaging step 25 on its upper surface at its distal end for snapping engagement with engaging hooks 43 of protuberant arms 42, 42 of the plug 12 as described hereinbelow. Similarly, the engaging flap 24 has a furrow 26 formed in its lower surface at its proximal end to thus yieldingly flex downwardly or toward the lower wall 23.

The resilient presser flap 17 is recessed at 27 in its middle to thus provide a guide plate 28. The guide plate 28 has a pair of guide slits 29, 29 formed therein and arranged in parallel spaced relation to each other along the side walls 37, 38. Although the pair of guide slits 29, 29 are formed in the illustrated embodiment; instead, either one of the guide slits 29, 29 will do. As shown in FIG. 3, each of the guide slits 29, 29 has a pair of notches 30, 30 on its out side edge to coact with the fitting lugs 34, 34 of the locking plate 14 in retaining the locking plate 14 either in locking position or in unlocking position. Although the pair of notches 30, 30 are shown here to be formed for each slit 29, the number of the notches 30 may be either one or more than two for each slit 29. As better shown in FIG. 4, the guide plate 28 has on its lower surface adjacent to the distal side on its middle a presser projection 31 which projects downwardly into the guide chamber 18 and is adapted to depress the resilient engaging flap 24 against its resiliency. The belt attaching portion 21 comprises a pair of extensions 37', 38' integrally extending from the side walls 37, 38 and a belt attaching rod 21' joining at its both ends the respective distal ends of the extensions 37', 38' to thus define a belt-inserting transverse slot 22 between the extensions 37', 38', the belt attaching rod 21' and the rear wall 20.

Figure 6:
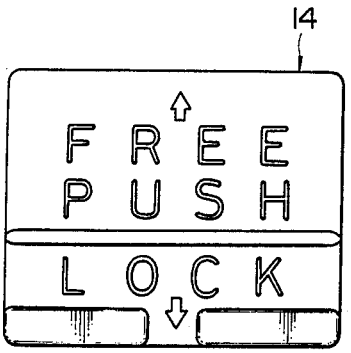
FIG. 6 is an enlarged front elevational view of a locking plate of the buckle.
Figure 7:
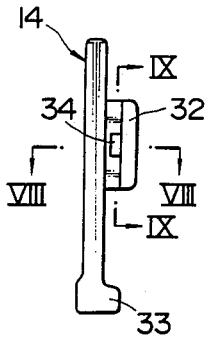
FIG. 7 is a side elevational view of the locking plate of FIG. 6.
Figure 8:
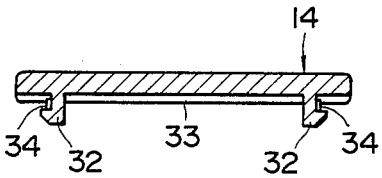
FIG. 8 is a cross-sectional view taken on line VIII—VIII of FIG. 7.
Figure 9:
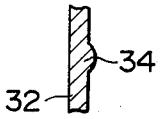
FIG. 9 is a cross-sectional view taken on line IX—IX of FIG. 7.
Figure 10:
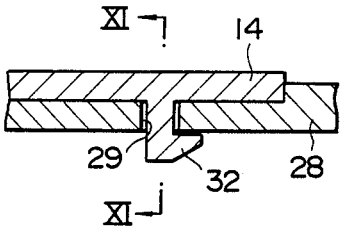
FIG. 10 is an enlarged cross-sectional view of those portions of the locking plate and the socket by which the locking plate is slidably mounted on the socket.
Figure 11:
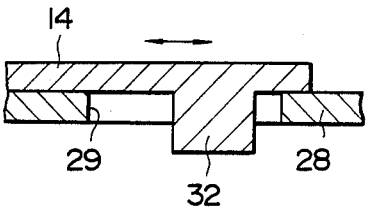
FIG. 11 is a cross-sectional view of XI—XI of FIG. 10.

As shown in FIGS. 6 through 9, the locking plate 14 is a substantially rectangular flat plate made of synthetic resin. The locking plate 14 has on its lower surface a pair of hooked engaging protuberances 32, 32 for slidable engagement with the guide slits 29, 29 of the resilient presser flap 17. It is to be readily noticed that the number of the hooked engaging protuberances 32, 32 correspond with the number of guide slits 29, 29 to be slidably engaged therewith. Since the locking plate 14 is made of flexible synthetic resin as mentioned above, forcing the locking plate 14 against the guide plate 28 with the engaging protuberances 32, 32 of the former registering with the guide slits 29, 29 of the latter would cause the engaging protuberances 32, 32 yieldingly come into snapping engagement with the guide slits 29, 29 as shown in FIG. 10, so that the locking plate 14 is slidably mounted on the guide plate 28 of the presser flap 17 as shown in FIG. 11. The locking plate 14 has on its lower surface at its rear end an abutment projection 33 which projects downwardly. Reference numerals 34, 34 denote a pair of engaging lugs one provided on the outer side of each engaging protuberance 32, 32. The engaging lugs 34, 34 are adapted for fitting engagement with the notches 30, 30 in order to selectively retain the locking plate 14 in locking position and in unlocking position. This lug-notch-engagement advantageously ensures that the locking plate 14 is firmly retained in locking position against unexpected unlocking. Although each engaging projection 32 is shown to have only one fitting lug 34, each engaging projection 32 may have a pair of juxtaposed fitting lugs 34, 34, in which event each guide slit 29 has two pairs of notches 30, 30 correspondingly. This advantageously helps to prevent the locking plate 14 from accidentally getting tilted relative to the guide plate 28 during the manipulation of the locking plate 14. As shown in FIG. 6, the upper surface of the locking plate 14 is preferably marked with "FREE" and "LOCK", so that the wearer could tell which position the locking plate 14 assumes at a glance.

Figure 12:
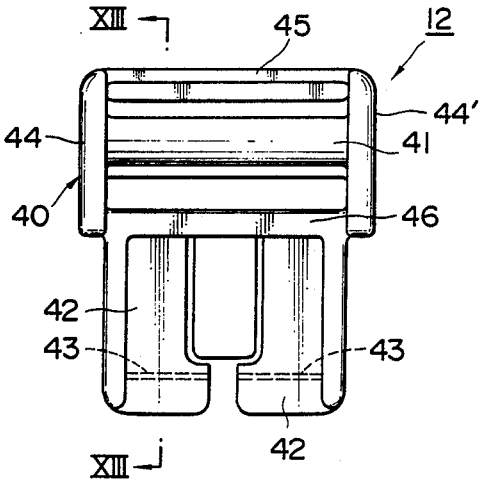
FIG. 12 is a front elevational view of a plug of the buckle.
Figure 13:
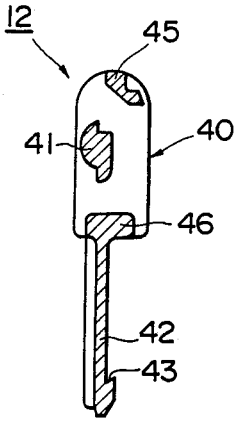
FIG. 13 is a cross-sectional view taken on line XIII—XIII of FIG. 12.

As shown in FIGS. 12 and 13, the plug 12 generally comprises a belt attaching portion 40 and a pair of protuberant arms 42, 42. The belt attaching portion 40 is in the form of a rectangular frame and comprises front, intermediate and rear rods 46, 41, 45 and a pair of side plates 44, 44' joining these rods at their respective opposed ends. The pair of arms 42, 42 extend integrally from the front rod 46 and project in side-by-side relation with each other in the plane of the belt attaching portion 40. The protuberant arms 42, 42 each have on its lower surface at its distal end an engaging hook 43 for snapping engagement with the engaging step 25 of the engaging flap 24.

For coupling the plug 12 and the socket 11 of the buckle 10, the protuberant arms 42, 42 of the plug 12 are thrusted into the opening 35 of the socket 11, thus bringing the engaging hooks 42, 42 into snapping engagement with the engaging step 25 of the engaging flap 24 so that the plug 12 is coupled with the socket 11.

For uncoupling the plug 12 from the socket 11, the wearer only has to depress, with any finger of a single hand, the locking plate 14 and hence the cantilevered resilient presser flap 17 downwardly, thus causing the presser projection 31 pass through between the juxtaposed protuberant arms 42, 42 of the plug 12 and come into depressing engagement with the resilient engaging flap 24. As a result, the engaging hooks 43 43 of the protuberant arms 42, 42 of the plug 12 comes out of engagement with the engaging step 25 of the engaging flap 24, whereby the plug 12 get decoupled from the socket 11.

Figure 15:
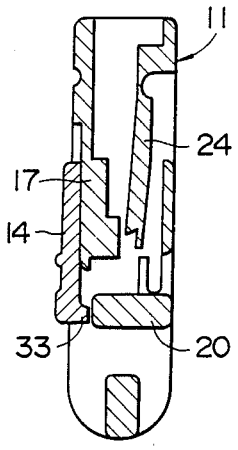
FIG. 15 is a view similar to FIG. 14 but showing the locking plate to assume locking position.

For locking the plug 12 and the socket 11 in coupled disposition, as shown in FIG. 15, the wearer only has to slide the locking plate 14 rearwardly, thus bringing the abutment projection 33 into abutting engagement with the rear wall 20. This abutting engagement precludes further depression of the locking plate 14, whereby the plug 12 and the socket 11 can be locked in coupled disposition.

Figure 14:
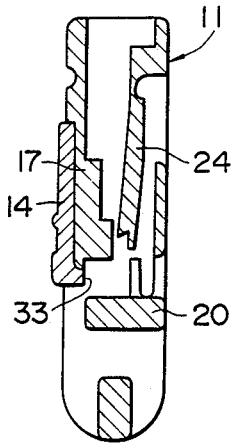
FIG. 14 is a cross-sectional view of the socket with the locking plate attached thereto but assuming unlocking position.

For unlocking the plug 12 and the socket 11, as shown in FIGS. 1 and 14, the wearer only has to slide back the locking plate 14 forwardly, thus bringing the abutment projection 33 out of abutting engagement with the rear wall 20, so that the plug 12 and the socket 11 have now been unlocked. Depressing the locking plate 14 in such unlocking position causes the plug 12 to be decoupled from the socket 11, as described hereinabove.

In the embodiment described hereinabove, the pair of protuberant arms 42, 42 extend integrally from the front rod 46 and project in side-by-side relation with each other and the presser projection 31 of the presser flap 17 passes through between the thus juxtaposed protuberant arms 42, 42 of the plug 12 so as to come into depressing engagement with the resilient engaging flap 24. Instead of the pair of protuberant arms 42, 42, only one arm 42 may extend integrally from the front rod 46, which protuberant arm 42 has a through hole therein. In this instance, the presser projection 31 of the presser flap 17 passes through the through hole of the protuberant arm 42 to thus come into depressing engagement with the resilient engaging flap 24. Alternatively, the resilient engagement flap 24 may extend somewhat beyond the distal end of the single protuberant arm 42 of the plug 12, when the plug 12 is fully inserted into the socket 11. The presser projection 31 passes off the distal end of the protuberant arm 42 to thus depress the resilient engaging flap 24.

Figure 16:
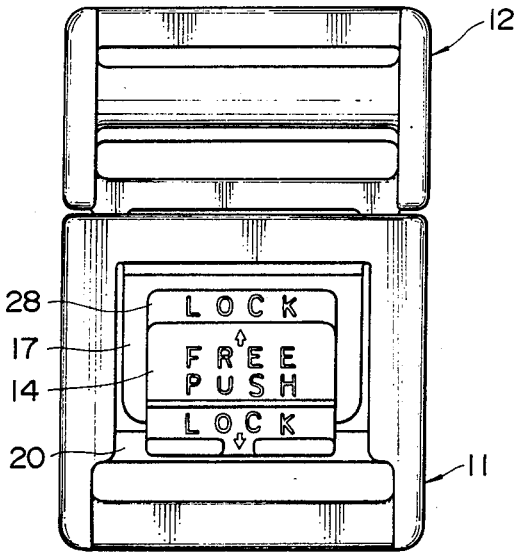
FIG. 16 is a view similar to FIG. 1 but shows the locking plate to assume locking position.

FIG. 16 shows the buckle 10 wherein the locking plate 14 assumes the locking position. That portion of the guide plate 28 which is exposed by the assumption of the locking position by the locking plate 14 may depict the mark "LOCK". With this mark depicted there, the wearer advantageously can tell whether the locking plate 14 assumes the locking position easily at a glance.

With the construction of the present invention mentioned hereinabove, it is very easy to couple the plug and socket and lock them in the coupled disposition as well as to unlock and uncouple them; particularly, in the latter event, the wearer can unlock and uncouple the plug and socket with only one touch, specifically by sliding and concurrently depressing the locking plate with one finger of one hand.

Furthermore, the locking plate can be assuredly retained either in the locking position or in the unlocking position so that there would be no likelihood that the buckle is uncoupled unexpectedly due to accidental unlocking of the locking plate even under severe stresses exerted on the buckle.

Obviously, various modifications and variations of the present invention are possible in the light of the above teaching. It is therefore to be understood that within the scope of the appended claims the invention may be practiced otherwise than as specifically described.

What is claimed is:

1. A buckle comprising a plug including a protuberant arm having first engaging means; and a socket adapted to be releasably coupled with the plug; the socket including a socket body including a pair of spaced upper and lower walls, a pair of side walls joining the upper and lower walls on their respective sides and a rear wall provided on the rear end of the lower wall to thus define therebetween a guide chamber open forwardly, the lower wall having a cantilevered resilient engaging flap projecting from its inner surface toward the rear wall and having second engaging means for snapping engagement with the first engaging means of the plug, the upper wall having a cantilevered resilient presser flap overhanging the cantilevered resilient engaging flap and being yieldable downwardly to thus depress the resilient engaging flap; and a locking plate having an abutting means and slidably mounted on the presser flap for causing the abutting means to come into abutting engagement with the rear wall, to thus lock the plug and the socket in coupled disposition.

2. A buckle according to claim 1, the cantilevered presser flap having a guide slot therein, the locking plate having on its lower surface an engaging protuberance for slidable engagement with the guide slot.

3. A buckle according to claim 2, the guide slot having at least two notches on its one edge, the engaging protuberance having on its side corresponding to the edge a fitting lug for selectively coming into fitting engagement with the notches.

4. A buckle according to claim 2, the guide slot having two pairs of notches on its one edge, the engaging protuberance having on its side corresponding to the edge a pair of fitting lugs for selectively coming into fitting engagement with the two pairs of notches.

5. A buckle according to claim 1, the first engaging means comprising an engaging hook provided on the lower surface and at the distal end of the protuberant arm, the second engaging means comprising an engaging step provided on the upper surface and at its distal end of the engaging flap and adapted for snapping engagement with the engaging hook.

6. A buckle according to claim 1, that portion of the presser flap which is exposed by the assumption of the locking position by the locking plate depicting the mark "LOCK".

7. A buckle according to claim 1, the presser flap having on its lower surface adjacent to the distal side on its middle a presser projection.

8. A buckle according to claim 7, the plug having a pair of protuberant arms projecting in side-by-side relation to each other, the presser projection passing through between the protuberant arms to thus come into depressing engagement with the engaging flap.

9. A buckle according to claim 7, the protuberant arm having a through hole therein, the presser projection passing through the through hole to thus come into depressing engagement with the engaging flap.

10. A buckle according to claim 7, the resilient engaging flap extending beyond the distal end of the protuberant arm when the plug is fully inserted into the socket, the presser projection passing through off the distal end of the protuberant arm to thus come into depressing engagement with the engaging flap.

11. A buckle according to claim 1, the abutting means comprising an abutment projection provided on the lower surface and at the rear end of the locking plate and projecting downwardly therefrom, the rear wall having a thickness such that its upper surface is slightly lower than that of the front wall.

* * * * *